US012765659B2

(12) United States Patent
Zheng et al.

(10) Patent No.: US 12,765,659 B2
(45) Date of Patent: Oct. 20, 2026

(54) DISPENSING PACKAGE FOR DISPENSING AND APPLYING A FLUID PRODUCT

(71) Applicant: APR Beauty Group Inc, Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Richmond Hill (CA)

( * ) Notice: Subject to any disclaimer, the term of this patent is extended or adjusted under 35 U.S.C. 154(b) by 257 days.

(21) Appl. No.: 18/652,332

(22) Filed: May 1, 2024

(65) Prior Publication Data

US 2025/0338944 A1 Nov. 6, 2025

(51) Int. Cl.
*A45D 40/00* (2006.01)
*A45D 40/26* (2006.01)

(52) U.S. Cl.
CPC ..... *A45D 40/0075* (2013.01); *A45D 40/26* (2013.01); *A45D 2200/055* (2013.01)

(58) Field of Classification Search
CPC ..... A45D 2200/055; A45D 2034/005; A45D 40/0075; A45D 40/04
USPC ..... 401/175, 265–266
See application file for complete search history.

(56) References Cited

U.S. PATENT DOCUMENTS

| | | | | |
|---|---|---|---|---|
| 2,079,744 | A * | 5/1937 | Maguire | B65D 83/761 604/407 |
| 2,816,309 | A | 12/1957 | Worth et al. | |
| 6,688,793 | B2 | 2/2004 | Goyet | |
| 7,972,075 | B2 * | 7/2011 | Tajima | B43K 8/02 401/265 |
| 8,544,684 | B2 * | 10/2013 | Perez | G01F 13/00 401/175 |
| 9,155,372 | B2 * | 10/2015 | Gieux | A45D 34/04 |
| 11,325,766 | B2 * | 5/2022 | Chen | B65D 77/0486 |
| 12,497,232 | B2 * | 12/2025 | Yang | A45D 40/26 |
| 2014/0323993 | A1 * | 10/2014 | Wilcox | A61M 35/003 604/311 |

* cited by examiner

*Primary Examiner* — David P Angwin
*Assistant Examiner* — Bradley S Oliver
(74) *Attorney, Agent, or Firm* — Jason Lee DeFrancesco

(57) ABSTRACT

A dispensing package for dispensing and applying a fluid product. The dispensing package comprises an applicator body with an application head. The applicator body encompasses an inner bottle that houses the fluid product. The application head comprises an application and dispensing face, and an inner cylindrical skirt extending downward from an inner surface thereof. A screw rod assembly is located at a bottom part of the inner bottle, threadedly engaged with a piston. A dialer is rotatably attached to the inner bottle, and non-rotatably attached to the screw rod assembly. The rotation of dialer moves the piston along the screw rod assembly, dispensing the fluid product through an orifice on the applicator head. A sealing plug within the applicator body seals an inner volume of the applicator head around the inner cylindrical skirt, ensuring the fluid product flows only into the inner cylindrical skirt from the inner bottle.

21 Claims, 12 Drawing Sheets

DISPENSING PACKAGE FOR DISPENSING AND APPLYING A FLUID PRODUCT

BACKGROUND

Field

The present disclosure generally relates to a dispensing package for dispensing and applying a fluid product. The fluid product can be a cosmetic or care product includes lip gloss, skincare, under-eye cosmetics, pharmaceutical, and like products.

Description of the Related Art

Containers with a separate dispensing head that are mounted on a container are known in the art. These dispensers can dispense a product as semi-solid or liquid. Such packages are configured as user operable dispensers where a semi-solid or liquid material is dispensed by the user holding a casing with one hand, removing a cap from an upper end of the casing, and selectively rotating a dial on a lower end of the casing to cause the pasty material to be dispensed from the upper end of the dispenser for application. A separate application head mounted on the distal end of the dispenser carries a risk of leakage from the joints. Further, in case of larger non-circular dispensing heads a large amount of residual product maybe left within an inner volume of the dispensing head as circular piston cannot move into and push the product accumulated in the non-circular inner volume of the dispenser head. This can lead to increased wastage.

In order to deliver a product in an efficient manner, particularly with large and integrated dispensing heads are known in the art as known from U.S. Pat. Nos. 2,816,309 and 6,688,793B2 for example.

There is a need for a dispensing package that overcomes abovementioned problems with a simple and cost-effective construction.

SUMMARY

Accordingly, there is provided a dispensing package to dispense a fluid product in the semi-solid or fluid form such as balms, creams and pastes. The dispensing package designed to minimize residual fluid product within the package, and has an application head with an enlarged surface area for product application.

According to an aspect of the present disclosure, the dispensing package comprises an application assembly and a cap that are removably engaged together using corresponding threads. The application assembly further comprises an applicator body that encloses an inner bottle, a sealing plug, and a dispensing assembly. The dispensing assembly further includes a screw rod assembly, a piston, a central plug and a dialer. The dispensing assembly is connected to both the applicator body and the inner bottle.

According to an aspect of the present disclosure, the inner bottle is designed to house the fluid product within its interior space. The applicator body encompasses both the top and lateral sides of the inner bottle, securely enclosing it within its structure. A lower portion of the applicator body is a cylindrical body, that envelops the inner bottle. An upper portion of the applicator body takes on the form of an application head, facilitating the application of the fluid product onto the user's skin. A shoulder portion lies between the cylindrical body and the application head.

The application head is formed as a single unit with the cylindrical body, application head, and the shoulder portion. However, in alternate embodiments, the application head may be a separate part. The shoulder portion is stepped in radially from the cylindrical body and the application head is stepped in radially from the shoulder portion. The cylindrical body of the applicator body has an open bottom end. The shoulder portion exhibiting a radial step inward from the cylindrical body, creates a distinct transition in diameter. Similarly, the application head features a radial step inward from the shoulder portion to delineate the boundary between the cylindrical body and the application head, and emphasizing the separation between these three components. This radial stepping aids in visual distinction between the different sections of the applicator body, contributing to its overall aesthetics and functionality.

According to another aspect of the present disclosure, the application head includes an application and dispensing face suitable for applying the product to skin of a user. The application and dispensing face is located at a front side of the application head. The application and dispensing face includes an orifice for dispensing the fluid product. The application head comprises a non-dispensing face opposing the application and dispensing face. The non-dispensing face of the application head is offset relative to application and dispensing face angularly around a periphery of said application head. In other words, the non-dispensing face covers a first portion of a peripheral contour of the application head, while the application and dispensing face covers a second portion of the peripheral contour of the application head. The non-dispensing face extends over the rear, left, and right sides of the applicator head, encompassing a larger area around the central longitudinal axis of the application head compared to the application and dispensing face.

In a preferred embodiment, the application and dispensing face of the application head exhibits a smoothly arched surface, curving outward from a cylindrical base of the application head to a tip thereof. A perimeter of the application and dispensing face is defined by a smooth ridge having a series of convex curves. Said perimeter exhibits a gentle first convex curve rising from an upper end of the cylindrical base of the application head, extending axially upward and with its convex facing the left side of the applicator head. The first convex curve transitions into a more pronounced second convex curve that intersects a plane of symmetry of the application head, the second convex curve face the rear side of the applicator head. The convex curve face concluding downwardly with a third convex curve near the cylindrical base. The third convex curve faces the right side of the applicator head. The third convex curve being similarly shaped as the first convex curve, having steeper slopes than a slope of the second convex curve. Notably, the second convex curve is central curve and is more pronounced than both the first and third convex curves contributing to the overall ergonomic design of the applicator head.

Furthermore, the application head includes the plane of symmetry that passes through the central longitudinal axis of the applicator head, and the plane of symmetry divides the second convex curve of the perimeter in two equal halves. The tip of the applicator head defined on the perimeter of the application and dispensing face lies on the plane of symmetry at an upper end of the application head.

According to another aspect of the present disclosure, in the side view of the applicator head, non-dispensing face majorly slopes towards the application face, having a subtle concave curve before smoothly merging with the periphery of the application and dispensing face. The application and dispensing face exhibits a greater inclination relative to the central longitudinal axis of the application head as compared to the non-dispensing face. Additionally, the application and dispensing face and the non-dispensing face are also curved convexly in a direction perpendicular to the central longitudinal axis of the applicator head. A convex curve of the application and dispensing face in a direction perpendicular to the central longitudinal axis of the applicator head being gentler than the convex curve of the non-dispensing face in a direction perpendicular to the central longitudinal axis of the applicator head, as a result the application and dispensing face appears flatter than the non-dispensing face.

The applicator body of the present disclosure can be made of but not limited to polymers such as polystyrene, polyvinyl chloride, polyethylene terephthalate or polyurethane, low density polyethylene (LDPE), high-density polyethylene (HDPE) or polypropylene.

According to yet another aspect of the present disclosure, the cap includes a sealing projection extending downwardly from an inner surface of an upper wall thereof. The sealing projection is configured to be inserted into the orifice of the applicator head to effectively seal the orifice when the cap is secured to the application assembly.

The application and dispensing face of the application head offers a large surface area for applying the product. In exemplary embodiment, a length of the application and dispensing face lies between 25-35 mm. A maximum width of the application and dispensing face lies in a range between 24-30 mm. The application head features a predominantly non-circular horizontal cross-section.

According to yet another aspect of the present disclosure, the application head further comprises an inner cylindrical skirt extending downward from an interior surface of the application and dispensing face, encircling the orifice from inner side thereof. The inner cylindrical skirt confines the product to flow through a defined pathway rather than filling an entire interior volume of the applicator head. The inner cylindrical skirt serves as a restricted pathway, efficiently managing and directing the product flow during application.

According to yet another aspect of the present disclosure, the applicator body incorporates an annular inner flange, positioned to sit atop the open upper end of the inner bottle. The annular inner flange is located near an upper end of the shoulder portion of the applicator body. Additionally, the applicator body features a first inner step positioned close to an upper end of the cylindrical body, as well as a second inner step located below, adjacent to, and slightly outwardly stepped from the first inner step. There are multiple radial ribs evenly spaced along an inner circumference of the applicator body between the first inner step and the second inner step of the applicator body.

The shoulder portion of the applicator body is provided with threads to engage with corresponding threads located on an inner surface of a sidewall of the cap. In alternate embodiments, the threads on the applicator body and threads on the cap may be replaced by snap fitment features or any other removably engagement means know in the art.

Furthermore, multiple equidistant protrusions are located at an inner circumference of the applicator head at the upper end of the cylindrical base of the application head. These protrusions serve to abut against an upper rim of the outer annular skirt of the sealing plug preventing any undesirable upward movement of the sealing plug into the applicator head.

According to yet another aspect of the present disclosure, the sealing plug includes an inner annular skirt encompassing a hollow space, an outer annular skirt spaced radially outward and co-axial with inner skirt, and an annular horizontal wall connecting lower ends of both the outer skirt and the inner skirt. The applicator body accommodates the sealing plug within its interior volume, specifically positioned at a lower end portion of the application head. When the sealing plug is received in the applicator body, the outer skirt of the sealing plug forms a tight seal with an inner surface of the application head at a lower end of the application head. Whereas, the inner annular skirt of the sealing plug encompasses the inner cylindrical skirt of the application head forming a sealing connection with it, and inner cylindrical skirt is accommodated in the hollow space encompasses by the inner annular skirt.

In a preferred embodiment the sealing plug is attached to the inner surface of the applicator body at distal end of the application head by a snap fit mechanism. Particularly, outer annular skirt of the sealing plug includes a projection that snaps into a corresponding groove located on inner circumference of the cylindrical base of the application head. Also, the inner annular skirt of the sealing plug securely snaps into place on the inner cylindrical skirt, providing a tight seal. In alternate embodiments, the sealing plug can be secured to the applicator body by any other securing means to ensure optimal sealing and stability of the components.

The sealing plug serves as a barrier to prevent product from flowing into a hollow space of the application head, surrounding the inner cylindrical skirt. This sealing plug plays a crucial role in maintaining an airtight seal around an inner volume of the application head, encasing the inner cylindrical skirt. The primary function of this airtight seal is to prevent any fluid product from entering the interior space of the application head, except for the designated area within the inner cylindrical skirt. By doing so, it minimizes the occurrence of residual product within the applicator head, which would otherwise remain inaccessible to the consumer. This is particularly significant as the piston cannot effectively push the product within the non-circular inner volume of the applicator head, emphasizing the importance of containing the fluid product within the inner cylindrical skirt for optimal use by the consumer.

According to yet another aspect of the present disclosure, the inner bottle has a cylindrical structure comprising a sidewall having an open lower end and an open upper end. The cylindrical shape of the inner bottle allows for easy insertion and removal from the cylindrical body of the applicator body, making it convenient for the user to refill and replace the bottle as needed. The inner bottle of the present disclosure can be made of a rigid material such as plastic or glass to ensure stability and durability during use.

An outer surface of the inner bottle has locking features that engage with the applicator body at the upper end. The locking features on the outer surface of the inner bottle are designed to securely attach it to the applicator body, preventing any leakage or spillage during use. The inner bottle comprises an annular protrusion on outer circumference thereof, located near the open upper end of the inner bottle. The annular snap protrusion is configured to be received within an annular snap groove located on an inner circumference of the applicator body at a lower end of the shoulder portion of the applicator body, to secure the inner bottle to the applicator body. The inner bottle further comprises an annular bead on outer circumference thereof, located near the open upper end of the inner bottle. The annular bead press against the inner circumference of the applicator body at the shoulder portion of the applicator body to provide leakproof seal between inner surface of the applicator body and the outer surface of the inner bottle.

Furthermore, the outer surface of the inner bottle includes a first outer annular flange positioned axially beneath the annular snap protrusion. The first outer annular flange includes a plurality of radial projections uniformly spaced from one another. The plurality of radial projections of the first outer flange fit snugly within the circumferential spaces between the multiple radial ribs located at the inner circumference of the applicator body bottle, preventing any rotation movement between the inner bottle and the applicator body.

The inner bottle has a second outer annular flange is located below the first outer annular flange positioned in continuation without any axial gap. The second outer annular flange extends radially outward to a greater distance than the first outer annular flange. During the assembly of the inner bottle with the applicator body, an upper surface of the first outer annular flange comes into contact with the first inner step of the applicator body, while an upper surface of the second outer annular flange rests against the second inner step of the applicator body.

Located near a lower portion of the inner bottle is a third outer annular flange. Additionally, the outer surface of the inner bottle includes an inverted L-shaped flange, positioned below the third outer annular flange. A sidewall of this inverted L-shaped flange extends downward to the lower end of the inner bottle. Further, sidewall of this inverted L-shaped flange incorporates an annular snap bead on an outer surface thereof for securing the inner bottle to the dialer. Moreover, the sidewall of the inverted L-shaped flange includes a plurality of flexible lugs projecting downwardly beyond a lower portion of the sidewall. The flexible lugs are configured to ride on a plurality of ratchet teeth provided in the dialer for facilitating the rotation of the dialer in a particular direction.

According to yet another aspect of the present disclosure, the dispensing package comprises a screw rod assembly, positioned rotatably at a bottom part of the inner bottle. The screw rod assembly is characterized by an elongated shape screw rod with threads formed along its outer surface. At a lower end of the screw rod, a support plate is integrally connected, providing vertical stability to the screw rod within the bottom part of the inner bottle. The support plate, resembling a disc, is secured on the bottom part of the inner bottle and fits snugly into an annular groove located on the inner surface of the bottom part of the inner bottle, thus securely attaching the screw rod to the inner bottle while allowing rotational movement. Additionally, a cylindrical part is attached to the lower face of the support plate, extending outside the bottom part of the inner bottle. Multiple ribs extend radially on the lower surface of the support plate, uniformly distributed along a circumference of the support plate. The multiple ribs assist in aligning the screw rod at the center of the dialer, ensuring stable positioning and facilitating rotation synchronized with the dialer. The support plate and a screw rod can be separate components or integral parts of the screw rod assembly. In the exemplary embodiment, the support plate and the screw rod are integrally formed. Additionally, the support plate also serves as a resting base for the piston at an initial stage. The screw rod assembly can be made of metal or hard plastic.

Further, the piston is coupled to the screw rod so that the piston ascends and descends as the screw rod assembly rotates. At this time, the outer surface of the piston contacts the inner diameter of inner bottle. The fluid product is received in the inner bottle and is accommodated in a space provided at an upper portion of the piston and is pressed when the piston is lifted and lowered.

According to yet another aspect of the present disclosure, the piston has an annular inner wall, an annular outer wall and a plate-shaped transverse annular wall connecting the annular inner wall to the annular outer wall. The annular outer wall is positioned at the outer periphery of the transverse wall, elastically contacting with the inner surface of the inner bottle at an upper point and a lower point. The annular outer wall has a shape slightly inward bend at center thereof.

Additionally, the annular inner wall of the piston has a through hole and a middle section of the annular inner wall includes screw threads formed in an inner periphery thereof. The annular inner wall allows the screw rod to passed through the through hole. The screw threads of the piston are configured to be connected to threads of the screw rod. Furthermore, the annular inner wall accommodates a central plug in the hollow interior thereof at an upper section thereof. More particularly, through hole has an upper half portion and a lower half portion, with the upper half portion is configured to receive and retain the central plug. The central plug is snap fitted into the upper half portion of the through hole.

According to yet another aspect of the present disclosure, the central plug is equipped with internal threads in a lower portion thereof that engages with threads of the screw rod, allowing it to move with the piston along with the screw rod as the piston moves upward. The central plug ensures that the threads of the screw rod remain clear of any build-up or product material. By moving upward along with the piston, the central plug physically clears the pitch of the screw rod as the piston moves up and down.

Furthermore, the central plug is a hollow cylindrical body with a through-hole is formed at the center thereof. The central plug includes an open lower end and an open upper end. An inner diameter of the open upper end portion of the central plug has a larger diameter as compared to its inner diameter at lower end portion thereof. An inner periphery of the lower end portion of the central plug is provided with corresponding threads to match with the threads of screw rod. The hollow cylindrical body of central plug has at least one annular bead and an upper flange extending outwardly from an upper edge of the hollow cylindrical body. The upper flange of the central plug rest upon the upper end of the annular inner wall of the piston, and at least one annular bead snaps into a corresponding annular groove provided on upper inner periphery of the annular inner wall to secure the central plug into the through hole of the piston. The central plug is made of a material having flexibility and elasticity, that makes an intimate contact, preferably airtight contact with the screw rod, such as NBR, silicon or any other material known in the art.

According to yet another aspect of the present disclosure, a cylindrical and sectional U-shaped dialer is connected to the lower end of the inner bottle, particularly to the inverted L-shaped flange of the inner bottle. The dialer has a peripheral wall and a bottom wall. An outer diameter of the peripheral wall is substantially equal to the cylindrical body of the applicator body. The bottom wall makes the dispensing package suitable to rest on a planar surface in an upright position. An annular groove is provided at upper end portion of an inner periphery of the peripheral wall of the dialer, which securely fastens onto the annular snap bead located on the outer surface the inverted L-shaped flange of the inner bottle.

Further, the dialer is provided with four group of protrusions which are aligned equidistant around an inner perimeter of the bottom wall of the dialer. The group of protrusions are engaged between the multiple ribs located at lower face of the support plat, assisting in aligning the screw rod and in installing the screw rod in a non-rotatable manner with respect to the dialer. Thus, when the dialer is rotated the screw rod also rotate along with it.

The peripheral wall of the dialer includes a plurality of ratchet teeth facing towards the upper end of the dialer that is provided at equidistant intervals in the circumferential direction on the peripheral wall of the dialer. The exemplary plurality of ratchet teeth and flexible lugs of the inner bottle cooperate to form a ratchet substantially preventing reverse rotation of the dialer in one of the circumferential directions. The flexible lugs ride along the ratchet teeth as the dialer rotates producing click sounds.

While the package is in use, the rotation of the dialer by the user will initiate the rotation of the screw rod. This rotation of the screw rod facilitates the upward movement of the piston along the screw thread of the screw rod towards the application head. In such a state, the movement of piston by rotating the dialer in one direction, ejects the fluid product received on the upper portion of the piston from the orifice of the applicator head. At this time, a user can eject only a necessary amount of the fluid product from the orifice by controlling the rotation of the dialer. At the last finishing time of the using, as the piston moves upward, it gradually reaches a final stage where the piston comes in intimate contact with the sealing plug, unable to move any further. At this final stage, the annular inner wall of the piston fits snugly into the cylindrical inner skirt of the applicator head, minimizing the residual product. Accordingly, it is possible to economically use the fluid product without waste.

Additional advantages, features, characteristics and aspects of the present invention follow from the claims and the following description of a preferred embodiment with reference to the drawing.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
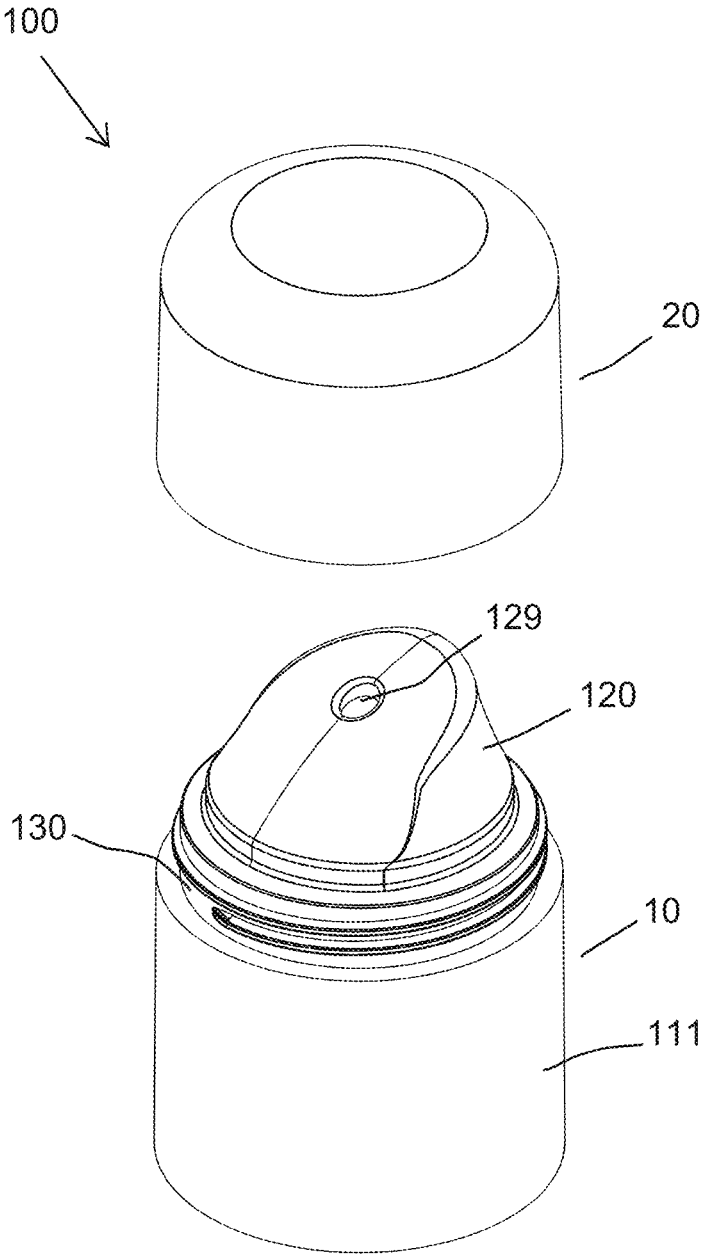
FIG. 1 illustrates a perspective view of a dispensing package, with a cap thereof shown in a disengaged position, according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

Figure 2:
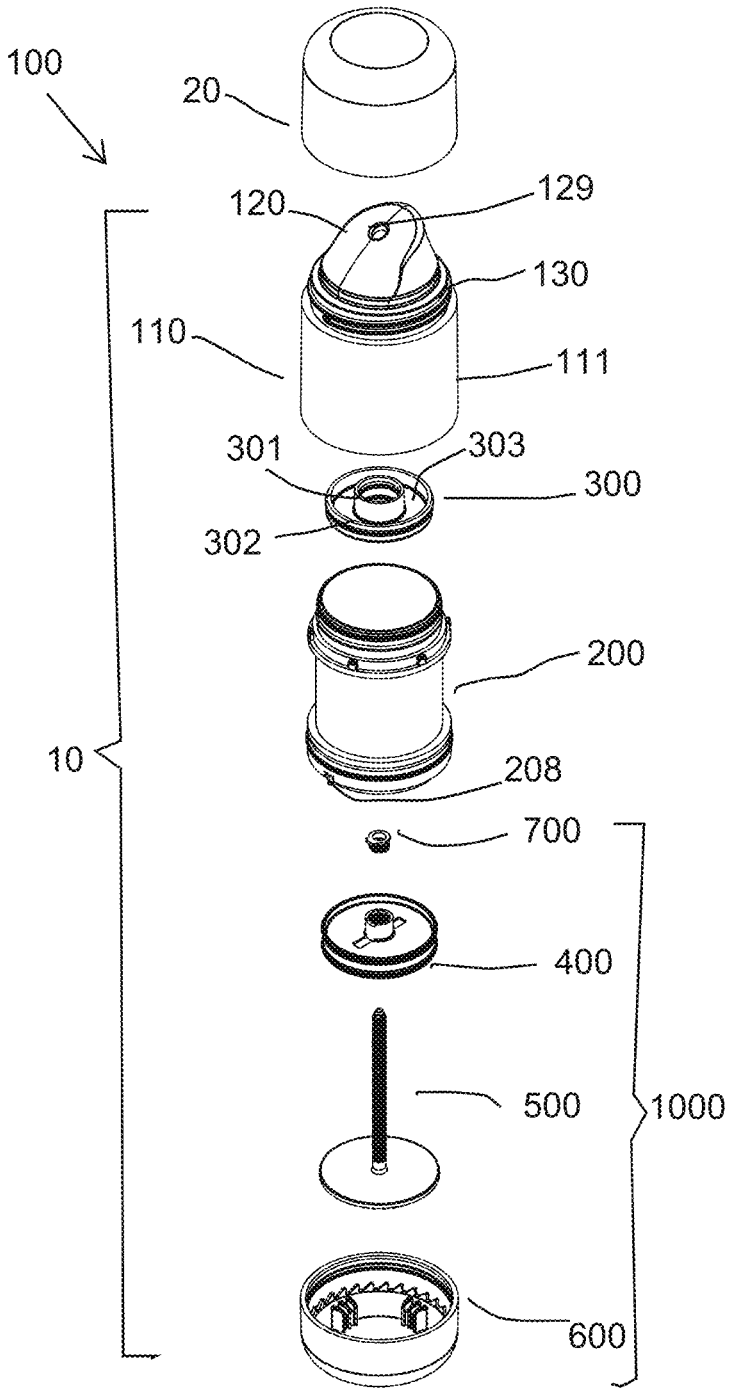
FIG. 2 illustrates an exploded view of the dispensing package of FIG. 1.
Figure 3:
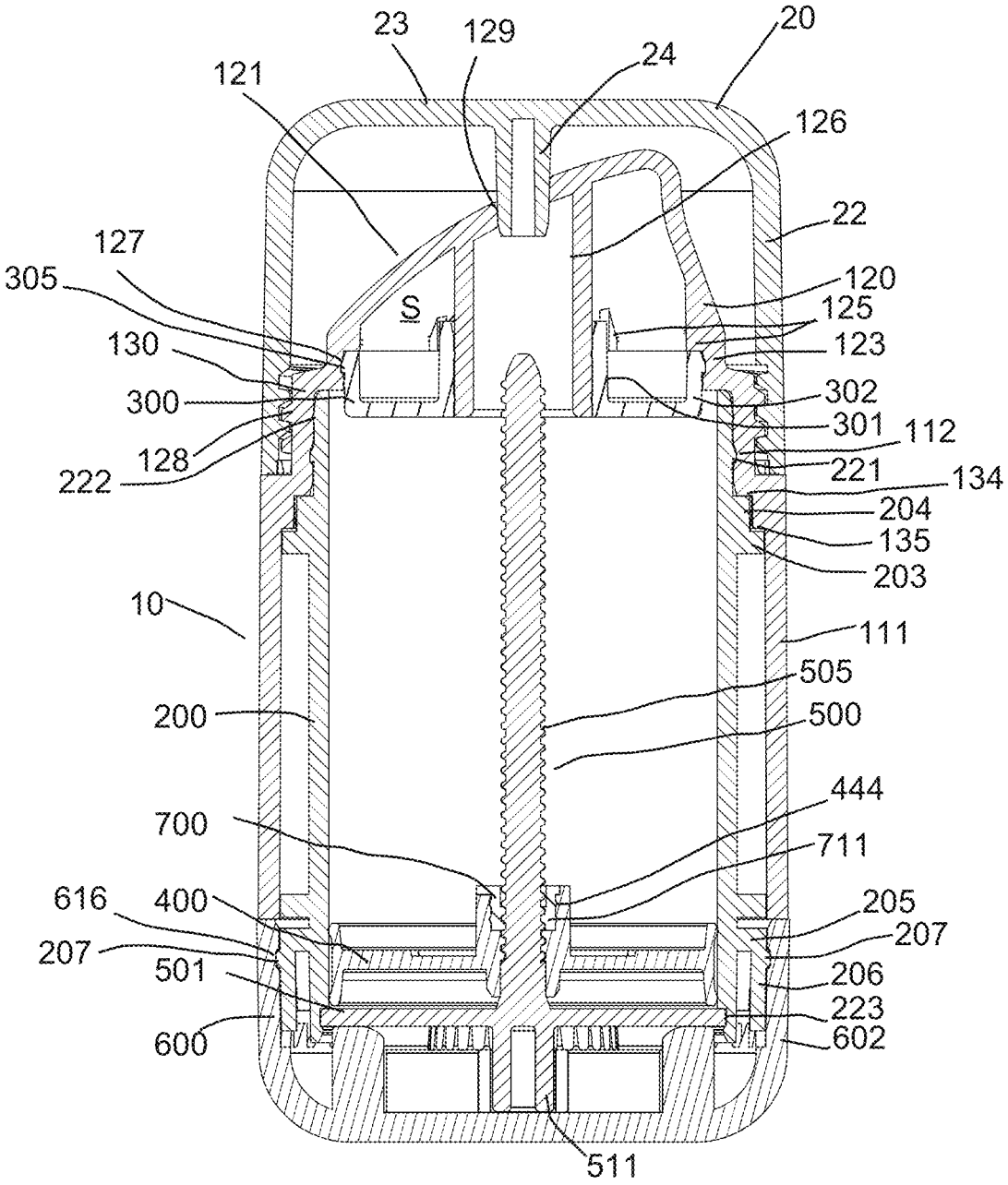
FIG. 3 illustrates a longitudinal cross-sectional view of the dispensing package of FIG. 1 with the cap engaged to the dispensing package.

FIGS. 1-3 show a dispensing package 100 for dispensing a fluid product such as a liquid/semi-solid or any other fluid like product, according to a preferred embodiment of the present disclosure. The fluid product can be more viscous than water or, optionally, even pasty. In particular, the product can also form a foam or a gel. The dispensing package 100 includes but not limited to a cosmetic or care product. The cosmetic or care product includes lip gloss, skincare, under-eye cosmetics, pharmaceutical, and like products.

Particularly, the dispensing package 100 is designed to dispense the fluid product in the semi-solid or fluid form such as balms, creams and pastes. The dispensing package 100 includes an application assembly 10 and a cap 20 that are designed to be fitted together using corresponding threads.

Referring to FIGS. 2 & 3, the application assembly 10 comprises an applicator body 110 that encloses an inner bottle 200, a sealing plug 300, and a dispensing assembly 1000. The dispensing assembly 1000 further includes a screw rod assembly 500, a piston 400, a central plug 700 and a dialer 600.

The inner bottle 200 is designed to house the fluid product within its interior space. The applicator body 110 encompasses both the top and lateral sides of the inner bottle 200, securely enclosing it within its structure.

The dispensing assembly 1000 is connected to both the applicator body 110 and the inner bottle 200.

The applicator body 110 can be made of but not limited to polymers such as polystyrene, polyvinyl chloride, polyethylene terephthalate or polyurethane, low density polyethylene (LDPE), high-density polyethylene (HDPE) or polypropylene.

Figure 4:
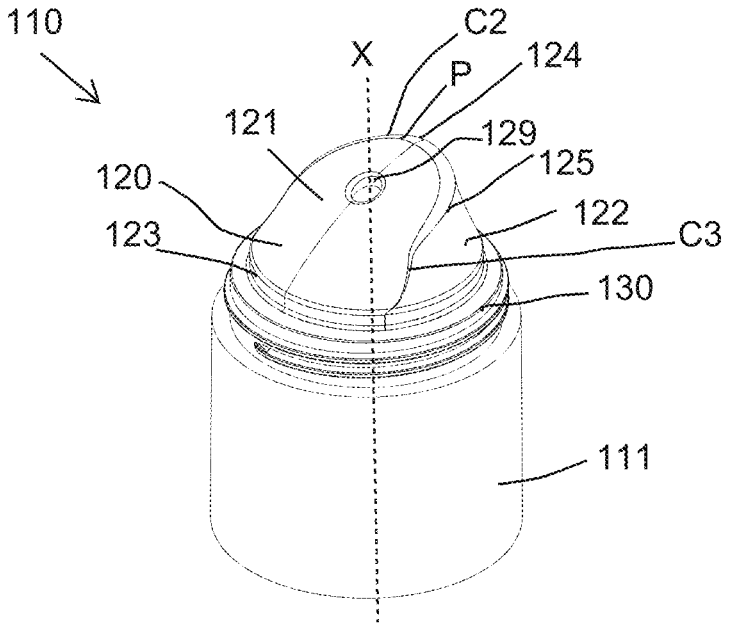
FIG. 4 illustrates a top perspective view of an applicator body of the dispensing package of FIG. 1.
Figure 5:
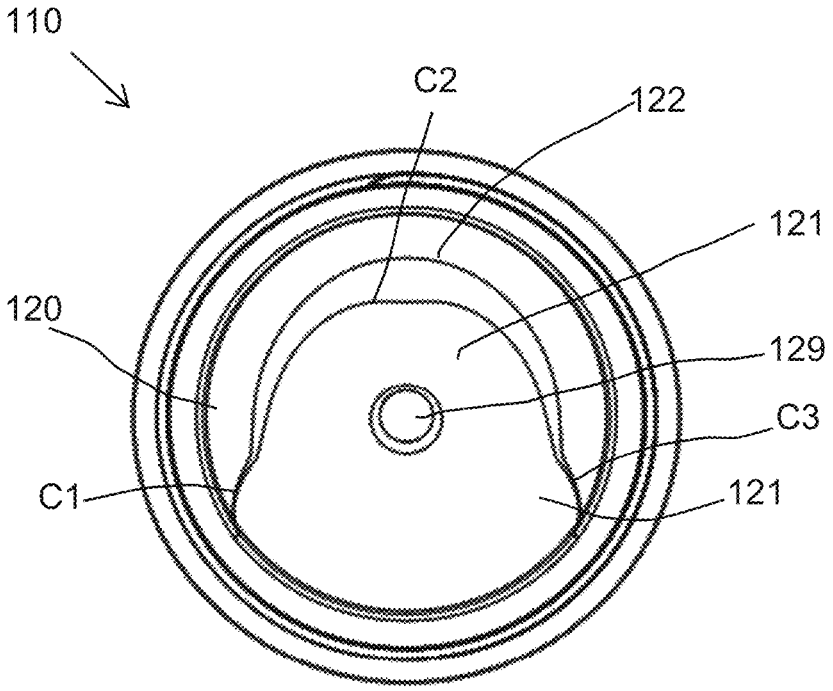
FIG. 5 illustrates a top view of an applicator body of the dispensing package of FIG. 1.

Referring to FIGS. 2, 3, and 4, a lower portion of the applicator body 110 is a cylindrical body 111, that envelops the inner bottle 200. An upper portion of the applicator body 110 takes the form of an application head 120, facilitating the application of the fluid product onto the user's skin. Further a shoulder portion 130 lies between the cylindrical body 111 and the application head 120.

The application head 120 is formed as a single unit with the cylindrical body 111, application head 120, and the shoulder portion 130. However, in alternate embodiments, the application head 120 may be a separate part. The shoulder portion 130 is stepped in radially from the cylindrical body 111 and the application head 120 is stepped in radially from the shoulder portion 130. The cylindrical body 111 of the applicator body 110 has an open bottom end. The shoulder portion 130 exhibits a radial step inward from the cylindrical body 111, creating a distinct transition in diameter. Similarly, the application head 120 features a radial step inward from the shoulder portion 130 to delineate the boundary between the cylindrical body 111 and the application head 120, and emphasizing the separation between these three components. This radial stepping aids in visual distinction between the different sections of the applicator body 110, contributing to its overall aesthetics and functionality.

Referring to FIGS. 4 to 10, the application head 120 includes an application and dispensing face 121 suitable for applying the product to skin of a user. The application and dispensing face 121 is located at a front side of the application head 120. The application and dispensing face 121 includes an orifice 129 for dispensing the fluid product. The application head 120 comprises a non-dispensing face 122 opposing the application and dispensing face 121. The non-dispensing face 122 of the application head 120 is offset relative to application and dispensing face 121 angularly around a periphery of said application head 120. In other words, the non-dispensing face 122 covers a first portion of a peripheral contour of the application head 120, while the application and dispensing face 121 covers a second portion of the peripheral contour of the application head 120. The non-dispensing face 122 extends over the rear, left, and right sides of the applicator head 120, encompassing a larger area around the longitudinal axis X compared to the application and dispensing face 121.

In exemplary embodiment, the application and dispensing face 121 of the application head 120 exhibits a smoothly arched surface, curving outward from a cylindrical base 123 of the application head 120 to a tip 124 thereof, referring to FIGS. 4 and 8-10. A perimeter P of the application and dispensing face 121 is defined by a smooth ridge having a series of convex curves. Said perimeter exhibits a gentle first convex curve C1 rising from an upper end of the cylindrical base 123 of the application head 120, extending axially upward and with its convex facing the left side of the applicator head 120. The first convex curve C1 transitions into a more pronounced second convex curve C2 that intersects a plane of symmetry of the application head 210, the second convex curve C2 face the rear side of the applicator head 120. The convex curve C2 face concluding downwardly with a third convex curve C3 near the cylindrical base 123. The third convex curve C3 faces the right side of the applicator head 120. The third convex curve C3 being similarly shaped as the first convex curve C1, having steeper slopes than a slope of the second convex curve C2. Notably, the second convex curve C2 is central curve and is more pronounced than both the first and third convex curves C2, C3, contributing to the overall ergonomic design of the applicator head 120.

Figure 6:
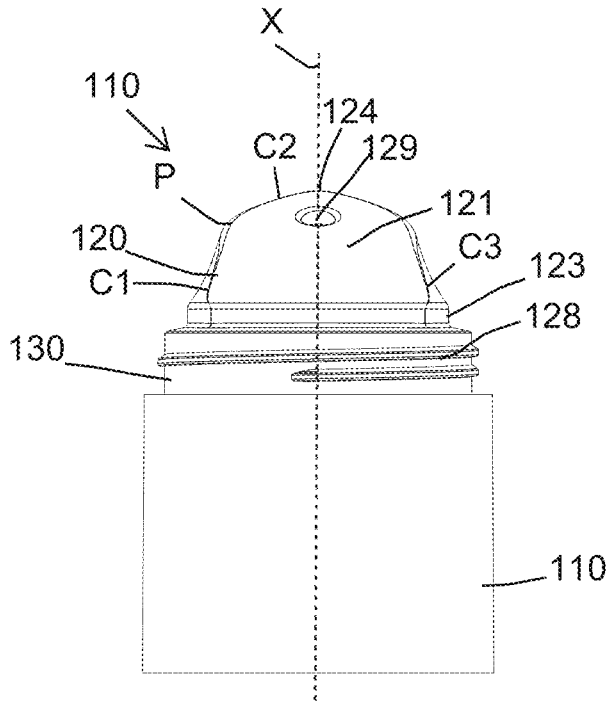
FIG. 6 illustrates a front view of the applicator body of FIG. 5.
Figure 7:
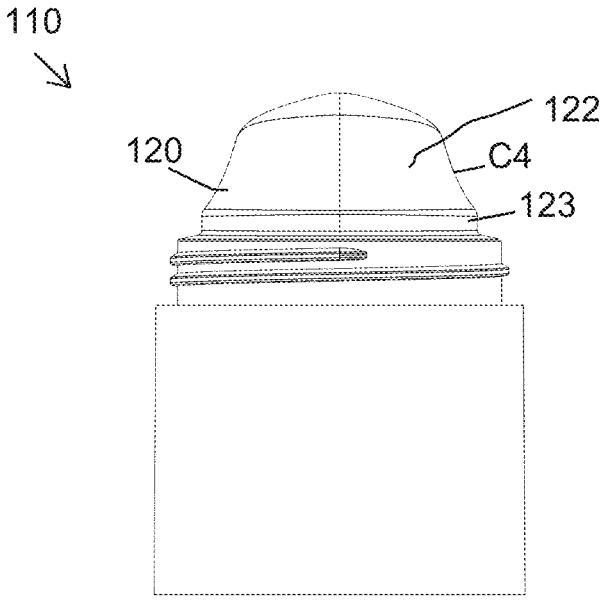
FIG. 7 illustrates a rear view of the applicator body of FIG. 5.

The application head 120 includes the plane of symmetry that passes through a central longitudinal axis X of the applicator head 120, and the plane of symmetry divides the second convex curve C2 of the perimeter in two equal halves, refer FIG. 6. The tip 124 of the applicator head 120 defined on the perimeter P of the application and dispensing face 121 lies on the plane of symmetry at an upper end of the application head 120.

Figure 8:
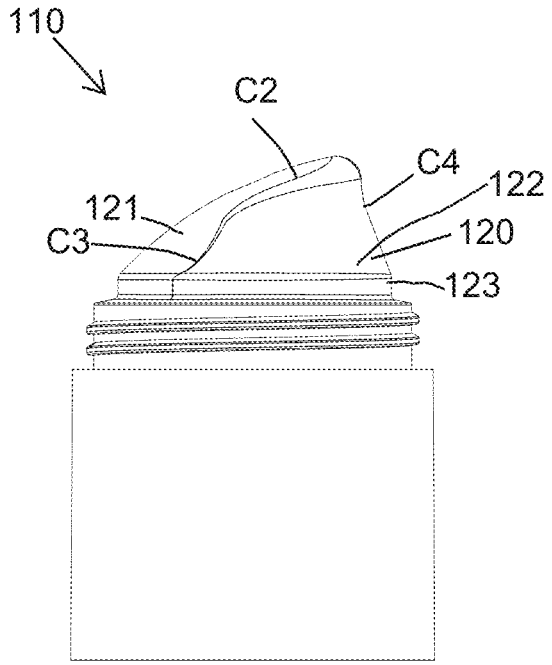
FIG. 8 illustrates a left side view of the applicator body of FIG. 5.
Figure 9:
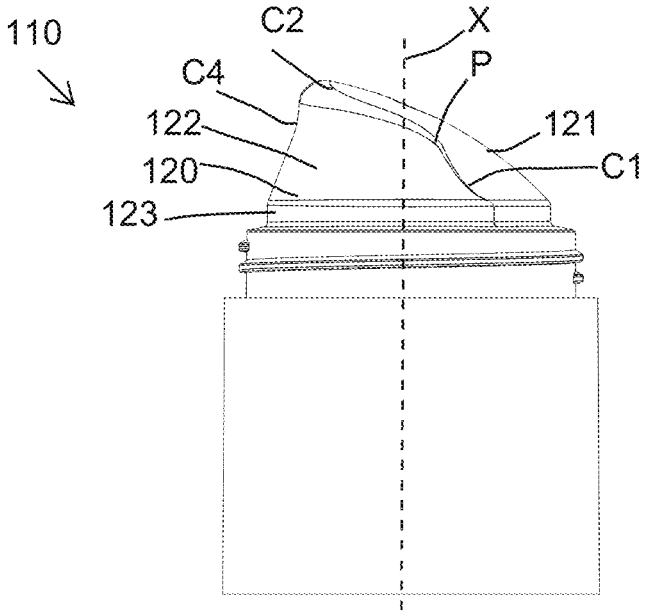
FIG. 9 illustrates a right side view of the applicator body of FIG. 5.

As seen FIGS. 8 and 9, the non-dispensing face 122 majorly slopes towards the application face 121, having a subtle concave curve C4 before smoothly merging with the periphery P of the application and dispensing face 121. The application and dispensing face 121 exhibits a greater inclination relative to the central longitudinal axis X as compared to the non-dispensing face 122. Additionally, the application and dispensing face 121 and the non-dispensing face 122 are also curved convexly in a direction perpendicular to the central longitudinal axis X of the applicator head 120. The convex curve of the application and dispensing face 121 in a direction perpendicular to the central longitudinal axis X of the applicator head 120 being gentler than the convex curve of the non-dispensing face 122, as a result the application and dispensing face 121 appears flatter than the non-dispensing face 122.

The cap 20 includes a sealing projection 24 extending downwardly from an inner surface of an upper wall 23 thereof. The sealing projection 24 is configured to be inserted into the orifice 129 of the applicator head 120 to effectively seal the orifice 129 when the cap 20 is secured to the application assembly 10.

The application and dispensing face 121 of the application head 120 offers a large surface area for applying the product. In exemplary embodiment, a length of the application and dispensing face 121 lies between 25-35 mm. A maximum width of the application and dispensing face 121 lies in a range between 24-30 mm. The application head 120 features a predominantly non-circular cross-section.

Figure 10:
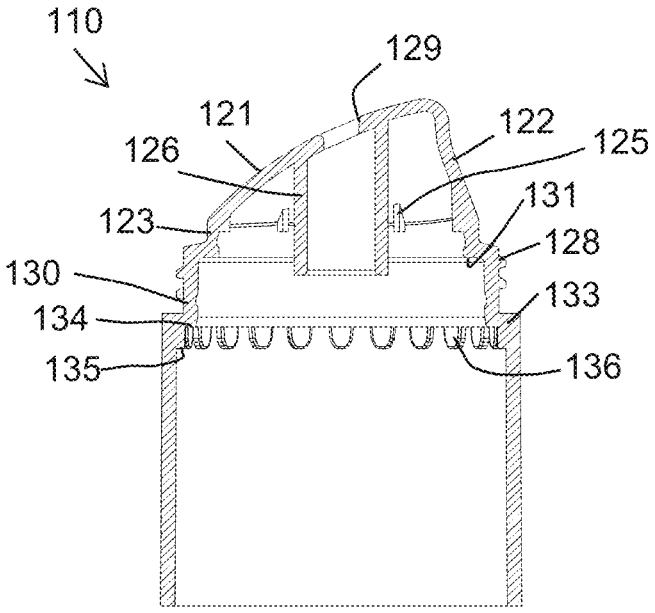
FIG. 10 illustrates a cross-sectional view of the applicator body of FIG. 5.

As seen in FIGS. 3 and 10, the application head 120 further comprises an inner cylindrical skirt 126 extending downward from an interior surface of the application and dispensing face 121, encircling the orifice 129 from inner side thereof. The inner cylindrical skirt 126 confines the product to flow through a defined pathway rather than filling an entire interior volume of the applicator head 120. The inner cylindrical skirt 126 serves as a restricted pathway, efficiently managing and directing the product flow during application.

Referring to FIG. 10, the applicator body 110 incorporates an annular inner flange 131, positioned to sit atop the open upper end of the inner bottle 200. The annular inner flange 131 is located near an upper end of the shoulder portion 130 of the applicator body 110. Additionally, the applicator body 110 features a first inner step 134 positioned close to an upper end of the cylindrical body 111, as well as a second inner step 135 located below, adjacent to, and slightly outwardly stepped from the first inner step 134. Between the first inner step 134 and the second inner step 135 of the applicator body 110, there are multiple radial ribs 136 evenly spaced along an inner circumference of the applicator body 110. The purpose if the first inner step 134 and the second inner step 135 would be defined in greater details later.

As seen in FIGS. 3 and 10, the shoulder portion 130 of the applicator body 110 is provided with threads 128 to engage with corresponding threads 26 located on an inner surface of a sidewall 22 of the cap 20. In alternate embodiments, the threads 128 on the applicator body 110 and threads 26 on the cap 20 may be replaced by snap fitment features or any other removably engagement means know in the art.

Figure 17:
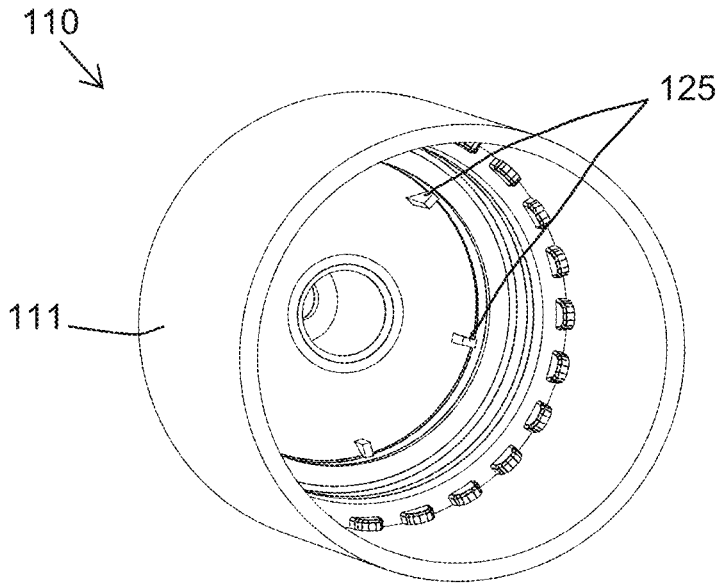
FIG. 17 illustrates a bottom perspective view of the applicator body of the dispensing package of FIG. 2.

Furthermore, multiple equidistant protrusions 125 are located at an inner circumference of the applicator head 120 at the upper end of the cylindrical base 123 of the application head 120, refer FIGS. 3, 10 and 17. These protrusions 125 serve to abut against an upper rim of the outer annular skirt 302 of the sealing plug 300 preventing any undesirable upward movement of the sealing plug 300 into the applicator head 300.

Referring to FIGS. 2 and 3, the sealing plug 300 includes an inner annular skirt 301 encompassing a hollow space, an outer annular skirt 302 spaced radially outward and co-axial with inner skirt 301, and an annular horizontal wall 303 connecting lower ends of both the outer skirt 302 and the inner skirt 301. The applicator body 110 accommodates the sealing plug 300 within its interior volume, specifically positioned at a lower end portion of the application head 120. When the sealing plug 300 is received in the applicator body 110, the outer skirt 302 of the sealing plug 30 forms a tight seal with an inner surface of the application head 120 at a lower end of the application head 120. Whereas, the inner annular skirt 301 of the sealing plug 30 encompasses the inner cylindrical skirt 126 of the application head 120 forming a sealing connection with it, and inner cylindrical skirt 126 is accommodated in the hollow space encompasses by the inner annular skirt 301. In this embodiment the sealing plug 300 is attached to the inner surface of the applicator body 110 at distal end of the application head 120 by a snap fit mechanism. Particularly, outer annular skirt 302 of the sealing plug 300 includes a projection 305 that snaps into a corresponding groove 127 located on inner circumference of the cylindrical base 123 of the application head 120, refer FIG. 3. Also, the inner annular skirt 301 of the sealing plug 300 securely snaps into place on the inner cylindrical skirt 126, providing a tight seal. In alternate embodiments, the sealing plug 300 can be secured to the applicator body 110 by any other securing means to ensure optimal sealing and stability of the components.

Figure 18:
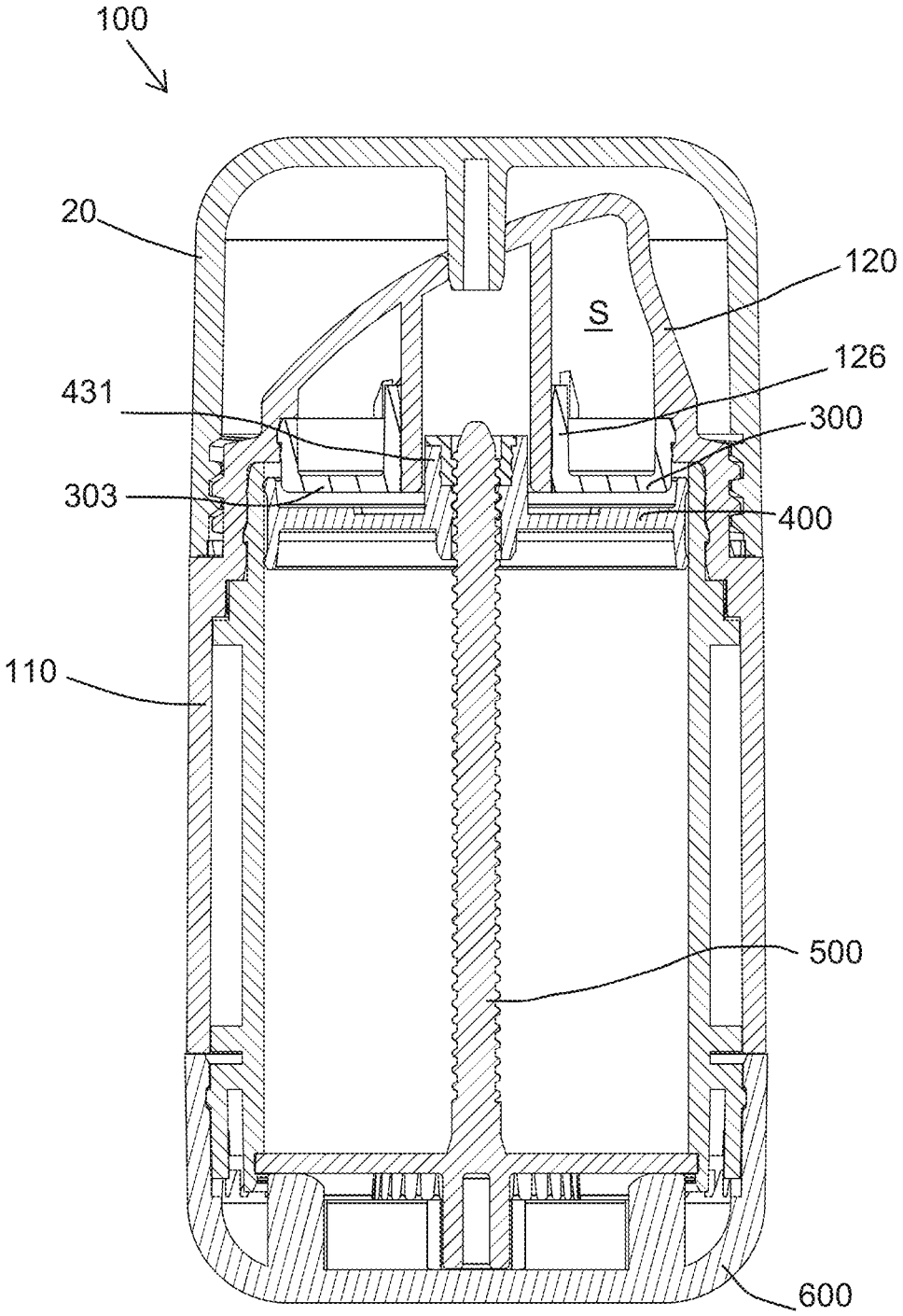
FIG. 18 illustrates a longitudinal cross-sectional view of the dispensing package of FIG. 2, showing a final position of the piston thereof.

Referring to FIGS. 3 and 18, the sealing plug 300 serves as a barrier to prevent product from flowing into a hollow space S of the application head 120, surrounding the inner cylindrical skirt 126. This sealing plug 300 plays a crucial role in maintaining an airtight seal around an inner volume of the application head 120, encasing the inner cylindrical skirt 126. The primary function of this airtight seal is to prevent any fluid product from entering the interior space of the application head 120, except for the designated area within the inner cylindrical skirt 126. By doing so, it minimizes the occurrence of residual product within the applicator head 120, which would otherwise remain inaccessible to the consumer. This is particularly significant as the piston 400 cannot effectively push the product within the non-circular inner volume of the applicator head 120, emphasizing the importance of containing the fluid product within the inner cylindrical skirt 126 for optimal use by the consumer.

Figure 11:
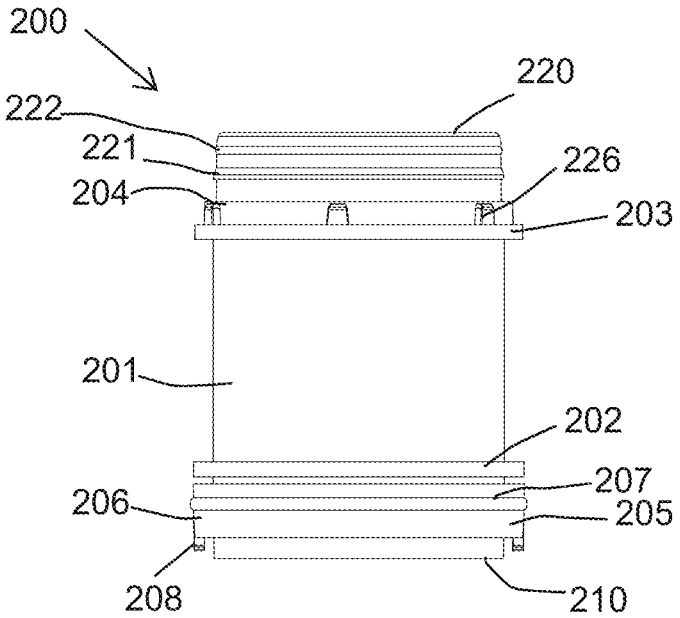
FIG. 11 illustrates a front view of an inner bottle of dispensing package of FIG. 2.

As shown in FIG. 11, the inner bottle 200 has a cylindrical structure comprising a sidewall 201 having an open lower end 210 and an open upper end 220. The cylindrical shape of the inner bottle 200 allows for easy insertion and removal from the cylindrical body 111 of the applicator body 110, making it convenient for the user to refill and replace the bottle as needed. Referring to FIGS. 11 and 3, an outer surface of the inner bottle 200 has locking features that engage with the applicator body 110 at the upper end 220. The locking features on the outer surface of the inner bottle 200 are designed to securely attach it to the applicator body 110, preventing any leakage or spillage during use. The inner bottle 200 can be made of a rigid material such as plastic or glass to ensure stability and durability during use.

The inner bottle 200 comprises an annular protrusion 221 on outer circumference thereof, located near the open upper end of the inner bottle 200. As seen in FIG. 3, the annular snap protrusion 221 is configured to be received within an annular snap groove 112 located on an inner circumference of the applicator body 110 at a lower end of the shoulder portion 130 of the applicator body 110, to secure the inner bottle 200 to the applicator body 110. The inner bottle 200 further comprises an annular bead 222 on outer circumference thereof, located near the open upper end of the inner bottle 200. The annular bead 222 press against the inner circumference of the applicator body 110 at the shoulder portion 130 of the applicator body 110 to provide leakproof seal between inner surface of the applicator body 110 and the outer surface of the inner bottle 200.

Furthermore, the outer surface of the inner bottle 200 includes a first outer annular flange 204 positioned axially beneath the annular snap protrusion 221. The first outer annular flange 204 includes a plurality of radial projections 226 uniformly spaced from one another. The plurality of radial projections 226 of the first outer flange 204 fit snugly within the circumferential spaces between the multiple radial ribs 136 located at the inner circumference of the applicator body 110 bottle, preventing any rotation movement between the inner bottle 200 and the applicator body 110.

A second outer annular flange 203 is located below the first outer annular flange 204 positioned in continuation without any axial gap. The second outer annular flange 203 extends radially outward to a greater distance than the first outer annular flange 204. During the assembly of the inner bottle 200 with the applicator body 110, an upper surface of the first outer annular flange 204 comes into contact with the first inner step 134 of the applicator body 110, while an upper surface of the second outer annular flange 203 rests against the second inner step 135 of the applicator body 110, refer FIG. 3.

Located near a lower portion of the inner bottle 200 is a third outer annular flange 202. Additionally, the outer surface of the inner bottle 200 includes an inverted L-shaped flange 205, positioned below the third outer annular flange 202, refer FIGS. 3 and 11. A sidewall 206 of this inverted L-shaped flange 205 extends downward to the lower end of the inner bottle 200. Further, sidewall 206 of this inverted L-shaped flange 205 incorporates an annular snap bead 207 on an outer surface thereof for securing the inner bottle 200 to the dialer 600.

The sidewall 206 of the inverted L-shaped flange 205 includes a plurality of flexible lugs 208 projecting downwardly beyond a lower portion of the sidewall 206. The flexible lugs 208 are configured to ride on a plurality of ratchet teeth 613 provided in the dialer 600 for facilitating the rotation of the dialer 600 in a particular direction.

Figure 13A:
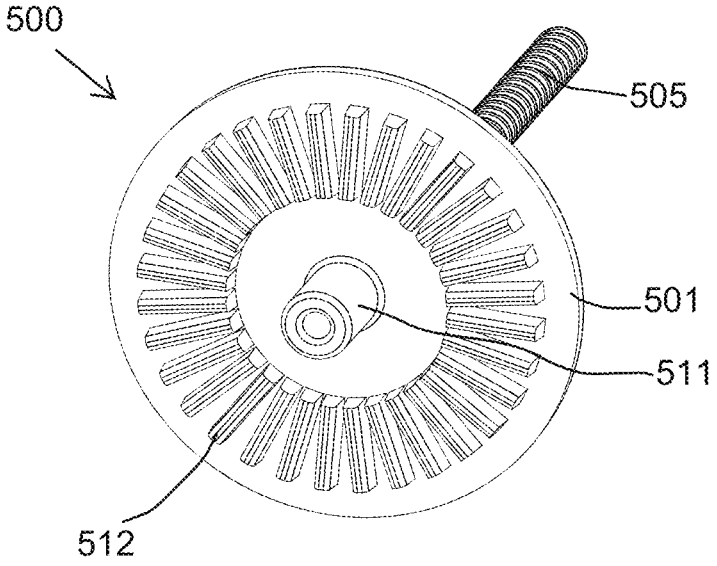
FIG. 13A illustrates a bottom perspective view of a screw rod assembly of dispensing package of FIG. 2.
Figure 13B:
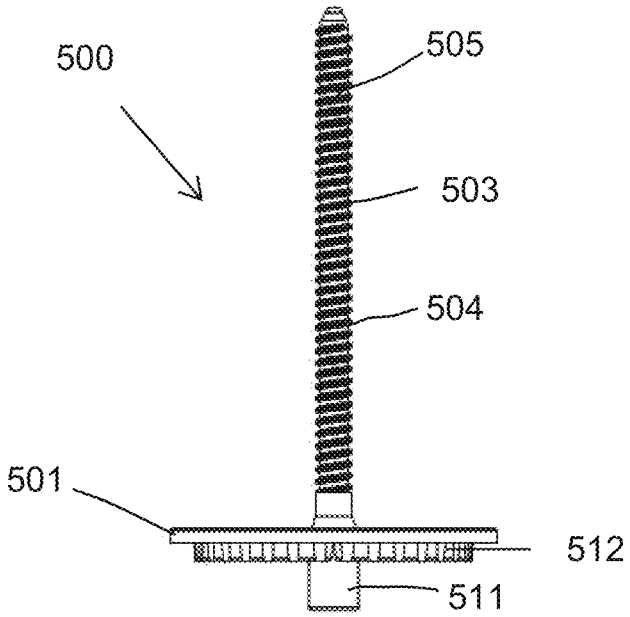
FIG. 13B illustrates a front view of the screw rod assembly of FIG. 13A.

As seen in FIG. 3, the dispensing package 100 comprises a screw rod assembly 500, positioned rotatably at a bottom part of the inner bottle 200. Referring to FIGS. 13A and 13B, the screw rod assembly 500 is characterized by an elongated shape screw rod 505 with threads 503 formed along its outer surface. At a lower end of the screw rod 505, a support plate 501 is integrally connected, providing vertical stability to the screw rod 505 within the bottom part of the inner bottle 200. The support plate 501, resembling a disc, is secured on the bottom part of the inner bottle 200 and fits snugly into an annular groove 223 located on the inner surface of the bottom part of the inner bottle 200, thus securely attaching the screw rod 500 to the inner bottle 200 while allowing rotational movement, refer FIG. 3. Additionally, a cylindrical part 511 is attached to the lower face of the support plate 501, extending outside the bottom part of the inner bottle 200. Multiple ribs 512 extend radially on the lower surface of the support plate 501, uniformly distributed along a circumference of the support plate 501. The multiple ribs 512 assist in aligning the screw rod 500 at the center of the dialer 600, ensuring stable positioning and facilitating rotation synchronized with the dialer 600. The support plate 501 and a screw rod 505 can be separate components or integral parts of the screw rod assembly 500. In the exemplary embodiment, the support plate 501 and the screw rod 505 are integrally formed. Additionally, the support plate 501 also serves as a resting base for the piston 400 at an initial stage. The screw rod assembly 500 can be made of metal or hard plastic.

Referring to FIGS. 2, the piston 400 is coupled to the screw rod 505 so that the piston 400 ascends and descends as the screw rod assembly 500 rotates. At this time, the outer surface of the piston 400 contacts the inner diameter of inner bottle 200. The fluid product is received in the inner bottle 200 and is accommodated in a space provided at an upper portion of the piston 400 and is pressed when the piston 400 is lifted and lowered.

Figure 12A:
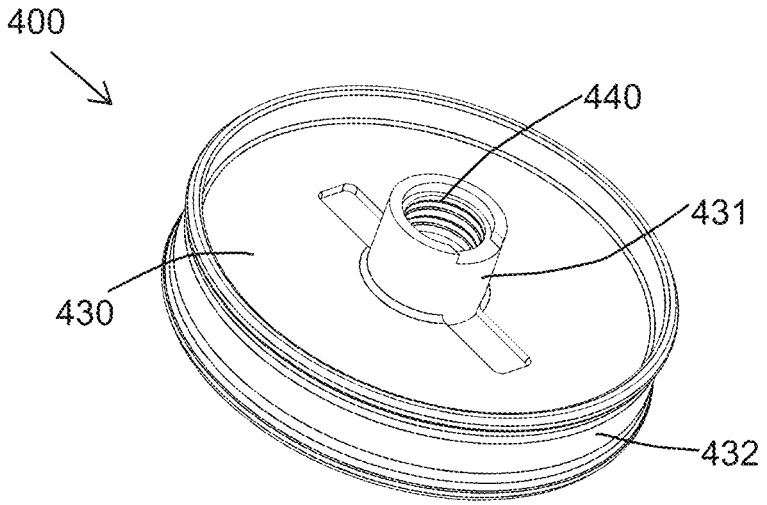
FIG. 12A illustrates a top isometric view of a piston of dispensing package of FIG. 2.
Figure 12B:
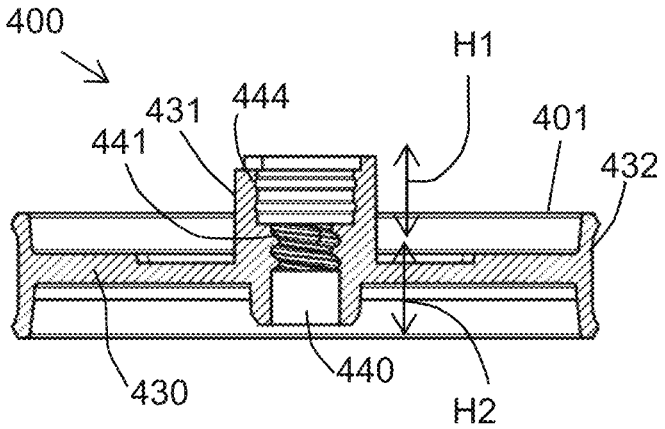
FIG. 12B illustrates a cross-sectional view of the piston of FIG. 12A.

As shown in FIGS. 12A and 12B, the piston 400 has an annular inner wall 431, an annular outer wall 432 and a plate-shaped transverse annular wall 430 connecting the annular inner wall 431 to the annular outer wall 432. The annular outer wall 432 is positioned at the outer periphery of the transverse wall 430, elastically contacting with the inner surface of the inner bottle 200 at an upper point and a lower point. The annular outer wall 432 has a shape slightly inward bend at center thereof.

As shown in FIGS. 12A and 12B, the annular inner wall 432 having a through hole 440 and a middle section of the annular inner wall 43 includes screw threads 441 formed in an inner periphery thereof. The annular inner wall 431 allows the screw rod 505 to passed through the through hole 440. The screw threads 440 of the piston 400 are configured to be connected to threads 503 of the screw rod 505. Additionally, the annular inner wall 431 accommodates a central plug 700 in the hollow interior thereof at an upper section thereof, refer FIG. 3. More particularly, through hole 440 has an upper half portion H1 and a lower half portion H2, with the upper half portion H1 is configured to receive and retain the central plug 700. The central plug 700 is snap fitted into the upper half portion H1 of the through hole 440.

As seen in FIG. 2, the central plug 700 is equipped with internal threads 711 in a lower portion thereof that engages with threads 503 of the screw rod 505, allowing it to move with the piston 400 along with the screw rod 505 as the piston 400 moves upward. The central plug 700 ensures that the threads 503 of the screw rod 505 remain clear of any build-up or product material. Any obstructions or accumulation between the threads 503 could impede the smooth movement of the circular piston 400 and affect the overall performance of the dispensing assembly 1000. By moving upward along with the piston 400, the central plug 700 physically clears the pitch 504 of the screw rod 502 as the piston 400 moves up and down.

Figure 14:
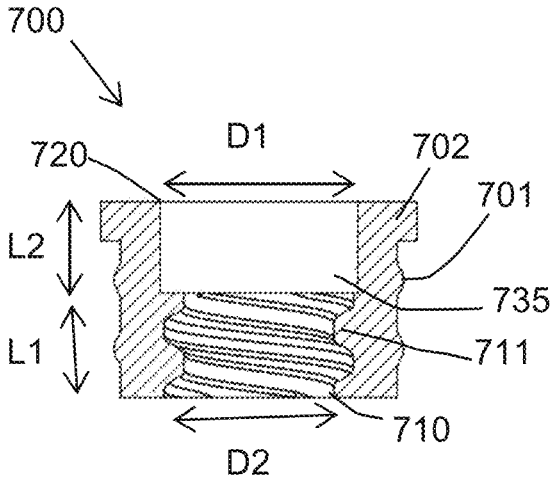
FIG. 14 illustrates a cross-sectional view of a central plug of dispensing package of FIG. 2.

Further referring to FIGS. 2, 3 & 14, the central plug 700 is a hollow cylindrical body with a through-hole 735 is formed at the center thereof. The central plug 700 includes an open lower end 710 and an open upper end 720. An inner diameter of the open upper end portion of the central plug 700 has a larger diameter D1 as compared to its inner diameter D2 at lower end portion thereof. An inner periphery of the lower end portion of the central plug 700 is provided with corresponding threads 711 to match with the threads 503 of screw rod 505. The hollow cylindrical body of central plug 700 has at least one annular bead 701 and an upper flange 702 extending outwardly from an upper edge of the hollow cylindrical body. The upper flange 702 of the central plug 700 rest upon the upper end of the annular inner wall 431 of the piston 400, and at least one annular bead 701 snaps into a corresponding annular groove 444 (FIG. 12B) provided on upper inner periphery of the annular inner wall 431 to secure the central plug 700 into the through hole 440 of the piston 400. The central plug 700 is made of a material having flexibility and elasticity, that makes an intimate contact, preferably airtight contact with the screw rod 505, such as NBR, silicon or any other material known in the art.

Figure 16:
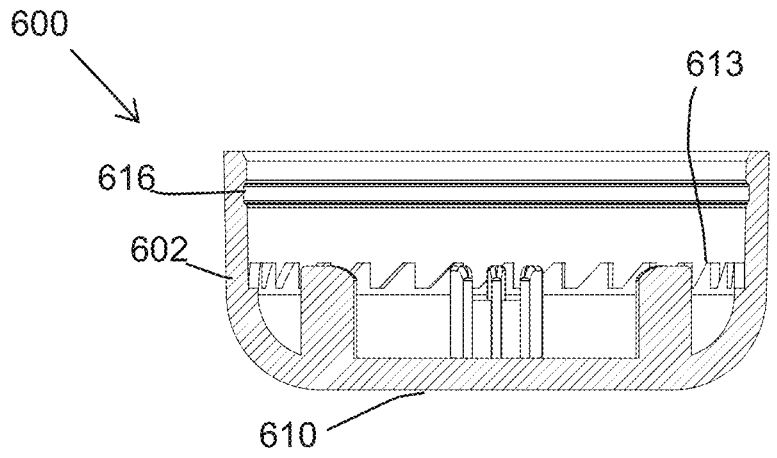
FIG. 16 illustrates a cross-sectional view of the dialer of FIG. 15.

Further, a cylindrical and sectional U-shaped dialer 600 is connected to the lower end of the inner bottle 200, particularly to the inverted L-shaped flange 205 of the inner bottle 200, refer FIG. 3. The dialer 600 has a peripheral wall 602 and a bottom wall 610, as shown in FIG. 16. An outer diameter of the peripheral wall 602 is substantially equal to the cylindrical body 111 of the applicator body 110. The bottom wall 610 makes the dispensing package 100 suitable to rest on a planar surface in an upright position. An annular groove 616 is provided at upper end portion of an inner periphery of the peripheral wall of the dialer 600, which securely fastens onto the annular snap bead 207 located on the outer surface the inverted L-shaped flange 205 of the inner bottle 200, see FIG. 3.

Figure 15:
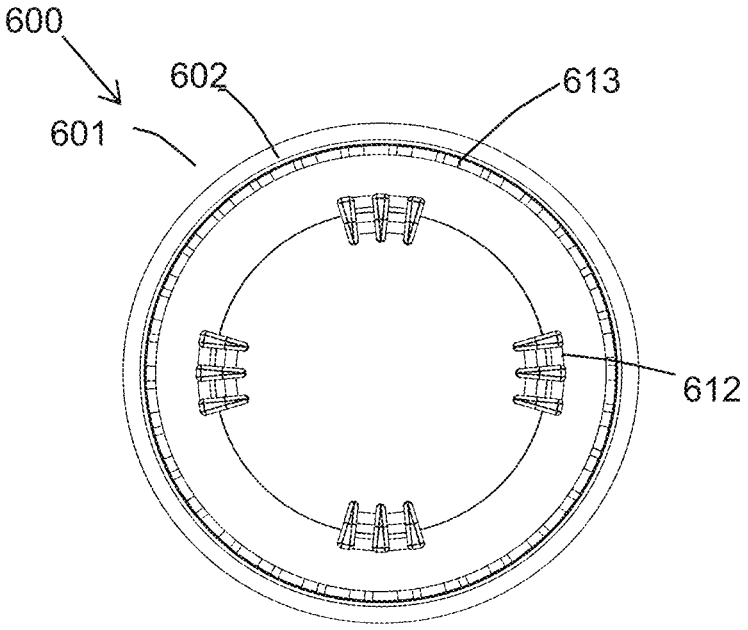
FIG. 15 illustrates a top view of a dialer of dispensing package of FIG. 2.

Further, referring to FIG. 15, the dialer 600 is provided with four group of protrusions 612 which are aligned equidistant around an inner perimeter of the bottom wall 610 of the dialer 600. The group of protrusions 612 are engaged between the multiple ribs 512 located at lower face of the support plat 501, assist in aligning the screw rod 500 and in installing the screw rod 500 in a non-rotatable manner with respect to the dialer 600. Thus, when the dialer 600 is rotated the screw rod 500 also rotate along with it. The peripheral wall 602 of the dialer 600 includes a plurality of ratchet teeth 613 facing towards the upper end of the dialer 600 that is provided at equidistant intervals in the circumferential direction on the peripheral wall 602 of the dialer 600. The exemplary plurality of ratchet teeth 613 and flexible lugs 208 of the inner bottle 200 cooperate to form a ratchet substantially preventing reverse rotation of the dialer 600 in one of the circumferential directions. The flexible lugs 208 ride along the ratchet teeth 613 as the dialer 600 rotates producing click sounds.

While the package 100 is in use, the rotation of the dialer 600 by the user will initiate the rotation of the screw rod 500. This rotation of the screw rod 500 facilitates the upward movement of the piston 400 along the screw thread 503 of the screw rod 502 towards the application head 120. In such a state, the movement of piston 400 by rotating the dialer 600 in one direction, ejects the fluid product received on the upper portion of the piston 400 from the orifice 129 of the applicator head 120. At this time, a user can eject only a necessary amount of the fluid product from the orifice 129 by controlling the rotation of the dialer 600.

Referring to FIG. 18, at the last finishing time of the using, as the piston 400 moves upward, it gradually reaches a final stage where the piston 400 comes in intimate contact with the sealing plug 300, unable to move any further. At this final stage, the annular inner wall 431 of the piston 400 fits snugly into the cylindrical inner skirt 126 of the applicator head 120, minimizing the residual product. Accordingly, it is possible to economically use the fluid product without waste.

Overall, the design of the dispensing package 100 ensures that the product remains fresh and effective for extended periods, while also providing a user-friendly experience for dispensing and application.

What is claimed is:

1. A dispensing package to dispense and apply a fluid product, the dispensing package comprises:

an applicator body, formed as a single unit, including a cylindrical body at a lower portion thereof, an application head at an upper portion thereof, and a shoulder portion between the cylindrical body and the application head;

an inner bottle accommodated inside the cylindrical body of the applicator body, the inner bottle configured to house the fluid product therein;

a sealing plug fixed within the applicator body, located at a lower end of the application head and positioned above the inner bottle;

a screw rod assembly positioned rotatably at a bottom part of the inner bottle;

a piston threadedly engaged with a screw rod of the screw rod assembly and having an annular outer wall elastically contacted with an inner surface of a side wall of the inner bottle;

a dialer for rotating the screw rod to slide the piston along the screw rod so that the fluid product in the inner bottle is lifted and discharged from an orifice located on the application head;

wherein the application head includes an application and dispensing face suitable for applying the product to skin of a user, at a front side thereof, and a non-dispensing face;

wherein the application and dispensing face includes the orifice for dispensing the fluid product;

wherein the non-dispensing face extends over the rear, left, and right sides of the applicator head, encompassing a larger area around a central longitudinal axis of the application head compared to the application and dispensing face;

wherein the application and dispensing face inclines towards a rear side of the application head, including a smoothly arched surface that extends from an upper end of a cylindrical base of the application head to a tip thereof;

wherein the non-dispensing face slopes towards the dispensing and application face, having a subtle concave curve before smoothly merging with a periphery of the application and dispensing face;

wherein the application and dispensing face has a greater inclination relative to the central longitudinal axis of the application head as compared to the non-dispensing face;

wherein the application head comprises an inner cylindrical skirt extending downward from an interior surface of the application and dispensing face, encircling the orifice from inner side thereof;

wherein the sealing plug includes an inner annular skirt encompassing a hollow space, an outer annular skirt spaced radially outward and co-axial with the inner skirt, and an annular horizontal wall connecting lower ends of both the outer skirt and the inner skirt; and wherein the outer skirt of the sealing plug forms a tight seal with an inner surface of the application head, and the inner annular skirt of the sealing plug form a sealing contact with an outer surface of the inner cylindrical skirt of the application head, preventing the fluid product from flowing into a hollow space of the application head that surrounds the inner cylindrical skirt.

2. The dispensing package according to claim 1, wherein a perimeter of the application and dispensing face includes a gentle first convex curve rising from an upper end of the cylindrical base of the application head, extending axially upward and with its convex facing the left side of the applicator head; wherein the first convex curve transitions into a more pronounced second convex curve that intersects a plane of symmetry of the application head, the second convex curve face the rear side of the applicator head; and wherein the second convex curve concluding downwardly with a third convex curve near the cylindrical base, the third convex curve faces the right side of the applicator head.

3. The dispensing package according to claim 2, wherein the third convex curve being similarly shaped as the first convex curve, having steeper slopes than a slope of the second convex curve.

4. The dispensing package according to claim 2, wherein the application and dispensing face and the non-dispensing face are curved convexly in a direction perpendicular to the central longitudinal axis of the applicator head; wherein the non-dispensing face covers a first portion of a peripheral contour of the application head, while the application and dispensing face covers a second portion of the peripheral contour of the application head; and wherein a convex curve of the application and dispensing face in a direction perpendicular to the central longitudinal axis of the applicator head being gentler than a convex curve of the non-dispensing face in a direction perpendicular to the central longitudinal axis of the applicator head.

5. The dispensing package according to claim 2, wherein the application head includes the plane of symmetry that passes through the central longitudinal axis of the applicator head, and the plane of symmetry divides the second convex curve of the perimeter in two equal halves; and wherein the tip of the applicator head is defined on the perimeter of the application and dispensing face lies on the plane of symmetry.

6. The dispensing package according to claim 1, wherein a length of the application and dispensing face lies between 25-35 mm; wherein a maximum width of the application and dispensing face lies in a range between 24-30 mm; and wherein the application head is predominantly non-circular.

7. The dispensing package according to claim 2, wherein the outer annular skirt of the sealing plug includes a projection that snaps into a corresponding groove located on an inner circumference of the cylindrical base of the application head; and wherein the inner annular skirt of the sealing plug securely snaps into place on the inner cylindrical skirt.

8. The dispensing package according to claim 1, wherein the dispensing package includes a cap configured to be removably engaged to the shoulder portion of the applicator body, and wherein an outer surface of the shoulder portion is provided with threads to engage with corresponding threads located on an inner surface of a sidewall of the cap.

9. The dispensing package according to claim 8, wherein the cap includes a sealing projection extending downwardly from an inner surface of an upper wall thereof; and wherein the sealing projection is configured to be inserted into the orifice of the applicator head to effectively seal the orifice.

10. The dispensing package according to claim 1, wherein the inner bottle has a cylindrical structure comprising a sidewall having an open lower end and an open upper end; wherein an outer surface of the inner bottle an annular protrusion on outer circumference thereof configured to be received within an annular snap groove located on an inner circumference of the applicator body; and wherein an annular bead is located on outer circumference of the inner bottle near the open upper end thereof; and wherein the annular bead press against the inner circumference of the applicator body at the shoulder portion of the applicator body.

11. The dispensing package according to claim 10, wherein the outer surface of the inner bottle includes an inverted L-shaped flange; wherein a sidewall of this inverted L-shaped flange extends downward to the lower end of the inner bottle; wherein the sidewall of the inverted L-shaped flange incorporates an annular snap bead on an outer surface thereof that snaps into an annular groove provided at an upper end portion of an inner periphery of a peripheral wall of the dialer.

12. The dispensing package according to claim 11, wherein the sidewall of the inverted L-shaped flange includes a plurality of flexible lugs projecting downwardly beyond a lower portion of the sidewall; and wherein the flexible lugs are configured to ride on a plurality of ratchet teeth provided in the dialer.

13. The dispensing package according to claim 12, wherein the plurality of ratchet teeth is provided at equidistant intervals in the circumferential direction on the peripheral wall of the dialer.

14. The dispensing package according to claim 1, wherein the screw rod assembly includes the screw rod with threads formed along its outer surface, and a support plate is integrally connected at a lower end of the screw rod; and wherein the support plate is secured on the bottom part of the inner bottle and fits snugly into an annular groove located on the inner surface of the bottom part of the inner bottle.

15. The dispensing package according to claim 14, wherein multiple ribs extend radially on the lower surface of the support plate, uniformly distributed along a circumference of the support plate; and wherein the dialer is provided with four group of protrusions, which are aligned equidistant around an inner perimeter of the bottom wall of the dialer, that engage between the multiple ribs for aligning the screw rod assembly and for installing the screw rod assembly in a non-rotatable manner with respect to the dialer.

16. The dispensing package according to claim 1, wherein the piston has an annular inner wall, an annular outer wall and a plate-shaped transverse annular wall connecting the annular inner wall to the annular outer wall; wherein the annular outer wall elastically contacts with an inner surface of the inner bottle; wherein the annular inner wall of the piston has a through hole and a middle section of the annular inner wall includes screw threads formed in an inner periphery thereof; and wherein the annular inner wall accommodates a central plug in the hollow interior thereof at an upper section thereof.

17. The dispensing package according to claim 16, wherein the central plug is a hollow cylindrical body with a through-hole is formed at the center thereof; wherein an inner diameter of the open upper end portion of the central plug has a larger diameter as compared to its inner diameter at lower end portion thereof; wherein an inner periphery of the lower end portion of the central plug is provided with corresponding threads to match with the threads of screw rod.

18. The dispensing package according to claim 17, wherein the hollow cylindrical body of central plug has at least one annular bead that snaps into a corresponding annular groove provided on upper inner periphery of the annular inner wall to secure the central plug into the through hole of the piston.

19. A dispensing package to dispense and apply a fluid product, the dispensing package comprises:

an applicator body, formed as a single unit, comprising a cylindrical portion and an application head, the application head having an application and dispensing face with an orifice for product dispensing;

an inner bottle housing the fluid product, the inner bottle enclosed by the cylindrical portion of the applicator body;

a sealing plug fixed within the applicator body, located at a lower end of the application head and positioned above the inner bottle;

a screw rod assembly positioned rotatably at a bottom part of the inner bottle, a screw rod of the screw rod assembly threadedly engaged with a piston, allows fluid product dispensing through the orifice on the application head;

a dialer for rotating the screw rod assembly to move the piston along the screw rod so that the fluid product in the inner bottle is discharged from the orifice located on the application head;

wherein the application head comprises an inner cylindrical skirt extending downward from an interior surface of the application and dispensing face, encircling the orifice from inner side thereof;

wherein the inner cylindrical skirt forms a passage, allowing the fluid product to flow from the inner bottle to the orifice of the applicator head;

wherein the sealing plug includes an inner annular skirt encompassing a hollow space, an outer annular skirt spaced radially outward and co-axial with the inner skirt, and an annular horizontal wall connecting lower ends of both the outer skirt and the inner skirt; and wherein the outer skirt of the sealing plug forms a tight seal with an inner surface of the application head, and the inner annular skirt of the sealing plug makes a sealing contact with an outer surface of the inner cylindrical skirt of the application head, preventing the flow of the fluid product from the inner bottle into a hollow space of the application head that surrounds the inner cylindrical skirt.

20. The dispensing package according to claim 19, wherein the application head includes a non-dispensing face opposing the application and dispensing face; wherein the non-dispensing face extends over the rear, left, and right sides of the applicator head, encompassing a larger area around a central longitudinal axis of the application head compared to the application and dispensing face; wherein the application and dispensing face inclines towards a rear side of the application head, including a smoothly arched surface that extends from an upper end of a cylindrical base of the application head to a tip thereof; and wherein the non-dispensing face slopes towards the dispensing and application face, having a subtle concave curve before smoothly merging with a periphery of the application and dispensing face; and wherein the application and dispensing face has a greater inclination relative to the central longitudinal axis of the application head as compared to the non-dispensing face.

21. A dispensing package to dispense and apply a fluid product, the dispensing package comprises:

an applicator body, formed as a single unit, comprising a cylindrical portion and an application head, the application head having an application and dispensing face with an orifice for product dispensing;

an inner bottle housing the fluid product, the inner bottle enclosed by the cylindrical portion of the applicator body;

a screw rod assembly positioned rotatably at a bottom part of the inner bottle, a screw rod of the screw rod assembly threadedly engaged with a piston, allows fluid product dispensing through the orifice on the application head;

a dialer for rotating the screw rod assembly to move the piston along the screw rod so that the fluid product in the inner bottle is discharged from the orifice located on the application head;

a sealing plug fixed within the applicator body, located at a lower end of the application head and positioned above the inner bottle;

wherein the application head comprises an inner cylindrical skirt extending downward from an interior surface of the application and dispensing face, encircling the orifice from inner side thereof, wherein the inner cylindrical skirt forms a passage, allowing the fluid product to flow from the inner bottle to the orifice of the applicator head;

wherein the sealing plug includes an inner annular skirt encompassing a hollow space, an outer annular skirt spaced radially outward and co-axial with the inner skirt, and an annular horizontal wall connecting lower ends of both the outer skirt and the inner skirt; and wherein the outer skirt of the sealing plug forms a tight seal with an inner surface of the application head, and the inner annular skirt of the sealing plug makes a sealing contact with an outer surface of the inner cylindrical skirt of the application head; and wherein at a final stage of the piston, the piston comes in intimate contact with the sealing plug unable to move any further, and at this final stage, an annular inner wall of the piston fits snugly into the cylindrical inner skirt of the applicator head.

* * * * *